US006149026A

United States Patent [19]

Manson

[11] Patent Number: 6,149,026

[45] **Date of Patent: *Nov. 21, 2000**

[54] SECONDARY CONTAINMENT TUB

[76] Inventor: Murray A. Manson, Box 827, Stettler, Alberta, Canada, T0C 2L0

[ * ] Notice: This patent issued on a continued prosecution application filed under 37 CFR 1.53(d), and is subject to the twenty year patent term provisions of 35 U.S.C. 154(a)(2).

[21] Appl. No.: 09/161,018

[22] Filed: Sep. 25, 1998

[51] Int. Cl.[7] ..... B65D 90/26

[52] U.S. Cl. ..... 220/560.03; 220/571; 220/567

[58] Field of Search ..... 220/571, 567, 220/23.83, 23.86, 4.24, 4.23, 4.22, 560.03; 52/194

[56] References Cited

U.S. PATENT DOCUMENTS

| | | | |
|---|---|---|---|
| 625,947 | 5/1899 | Berquist | 220/567 |
| 3,310,905 | 3/1967 | Davis et al. | 220/4.24 |
| 5,246,151 | 9/1993 | Jabara | 224/544 |
| 5,263,772 | 11/1993 | Ritzow | 312/138.1 |
| 5,417,344 | 5/1995 | Wells et al. | 220/571 |
| 5,454,478 | 10/1995 | Everson | 220/23.83 |
| 5,531,098 | 7/1996 | Bybee | 73/35.17 |
| 5,752,617 | 5/1998 | Yung | 220/571 |

OTHER PUBLICATIONS

Copy of Brochure of Eagle Manufacturing Co., Wellsburg, WV 26070 Re. Haz–Mat Products. Copy of Brochure of Westeel, Winnipeg Describing "Retro–Vault" Flyer by Jim Mackie, Pres., Fuels Safety Consultants re. Petroleum utilization equipment.

"*Tanks & Storage*", 24 pg. catalog (vol. 3, No. 1, Apr. '98, a Supplement to Canadian Environmental Protection, Heavy Equipment Guide, Oil and Gas Product News, Recycling Product News & Agriculture Product News). Flyer re. Containment Products from Can–Ross Environmental Services.

*Primary Examiner*—Stephen Castellano
*Attorney, Agent, or Firm*—Frank J. Dykas; Robert L. Shaver

[57] ABSTRACT

A secondary containment tub, comprising a lower leak proof compartment having an upper rim and a base and a cover hinged to the upper rim by hinges. A metal collar extends around the upper rim. A flange on the base is provided for securing the lower leak proof compartment to a support. A tank is disposed within the secondary containment tub, with the tank being supported above the base of the lower leak proof compartment, preferably on a metal frame, at a level such that the tank cannot float in fluid spilled from the tank into the lower leak proof compartment.

19 Claims, 3 Drawing Sheets

SECONDARY CONTAINMENT TUB

FIELD OF THE INVENTION

This invention relates to secondary containment apparatus.

BACKGROUND OF THE INVENTION

In secondary containment, it is common to use a larger tank to enclose a smaller tank that stores hazardous chemicals. Spills are caught by the larger tank. For example, Eagle Manufacturing Company of Wellsburg, W.V. 26070, makes a heavy duty polyethylene unit which has a tapered lower compartment and a hinged two piece lockable tapered cover. This product apparently works for its intended purpose, but lacks advanced features for convenience of the operator.

SUMMARY OF THE INVENTION

It is an object of this invention to provide a secondary containment tub that provides spill containment for a variety of tanks.

It is an object of this invention to provide a secondary containment tub that provides convenient quick access for inspection of a tank, and does not require the tank to have expensive leak detection equipment.

It is an object of this invention to provide a secondary containment tub that protects the life and finish of a tank while providing emergency venting for containment.

It is an object of this invention to provide a secondary containment tub that requires no dike, no liner, no gravel and no excavation, which prevents contamination of the environment and which eliminates reclamation expenses.

There is therefore provided in accordance with an aspect of the invention a secondary containment tub, comprising a lower leak proof compartment having an upper rim and a base and a cover hinged to the upper rim by hinges.

In a further aspect of the invention, a metal collar extends around the upper rim.

In a further aspect of the invention, a flange on the base is provided for securing the lower leak proof compartment to a support.

In a further aspect of the invention, a tank is disposed within the secondary containment tub, with the tank being supported above the base of the lower leak proof compartment at a level such that the tank cannot float in fluid spilled from the tank into the lower leak proof compartment.

In a further aspect of the invention, the hinges are secured to the metal collar.

In a further aspect of the invention, the metal collar is formed of an angle iron.

In a further aspect of the invention, the tank is supported on a stand within the lower leak proof compartment.

In a further aspect of the invention, there is provided a support for the lower leak proof compartment.

In a further aspect of the invention, the support is clamped to the lower leak proof compartment by a clamp fastened over the flange.

In a further aspect of the invention, the support comprises a metal frame having four support legs.

In a further aspect of the invention, the support comprises a metal frame having four support legs.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
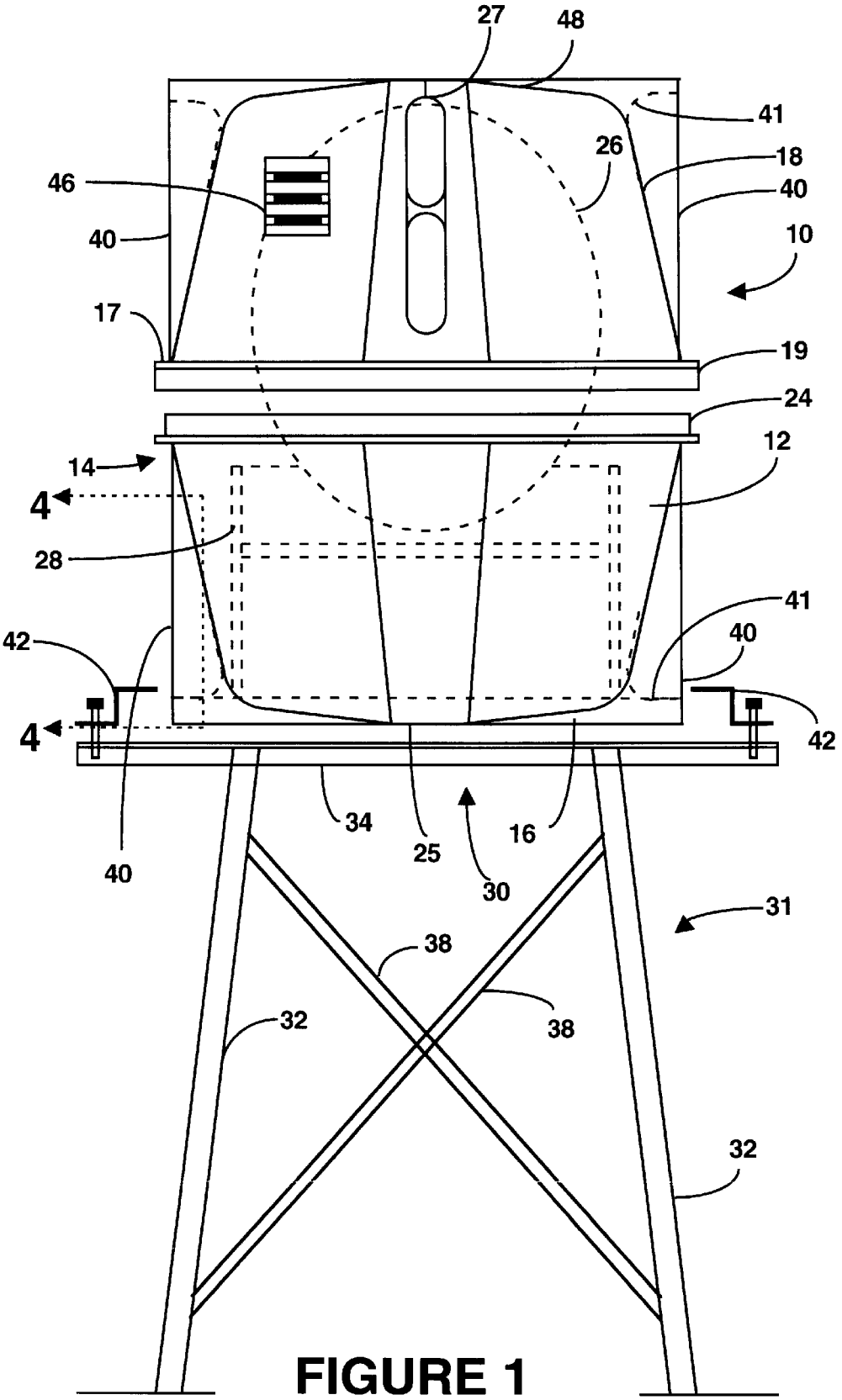
FIG. 1 is a an end view of a secondary containment tub according to the invention.
Figure 2:
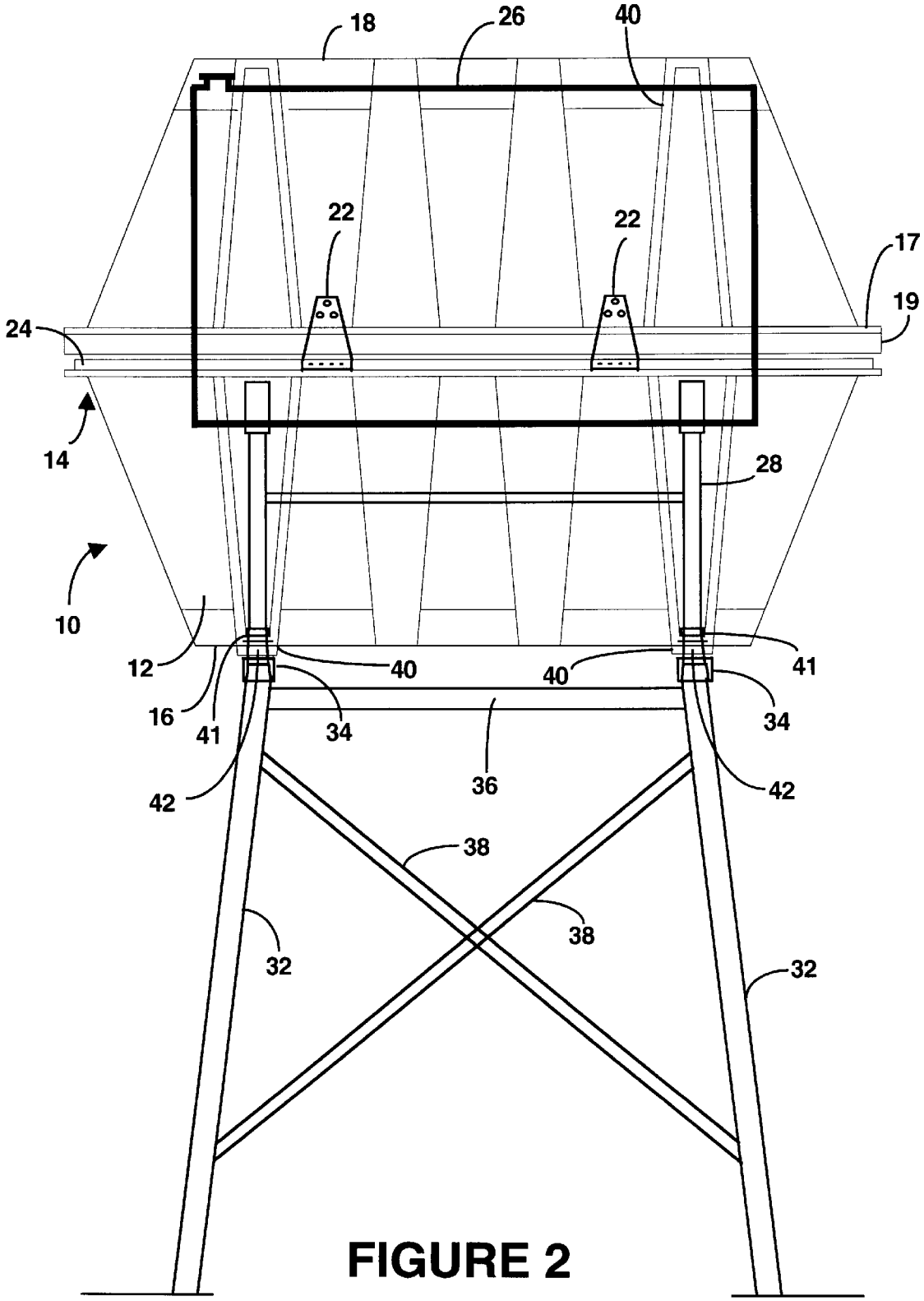
FIG. 2 is a side view of the secondary containment tub of FIG. 1.
Figure 3:
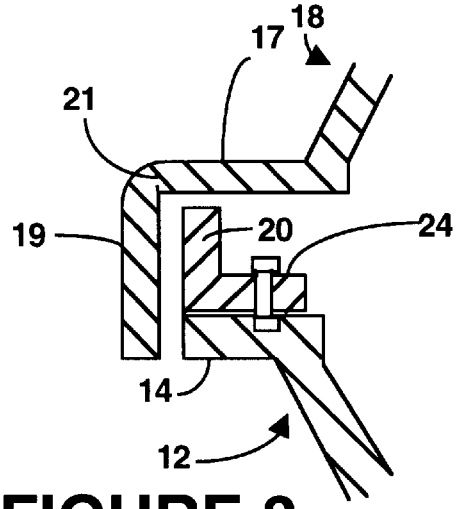
FIG. 3 is a section through the rim of the lower leak proof compartment of the secondary containment tub of FIGS. 1 and 2.

Referring to the figures, there is shown a secondary containment tub 10 which is formed of a lower leak proof compartment 12 having an upper rim 14 and a base 16. A cover 18 for the secondary containment tub 10 is hinged to the upper rim 14 by hinges 22. The cover 18 may be a single unit with hinges 22 along the side as shown, or may be split in the middle (lengthwise or sideways) to form a butterfly cover. The cover 18 preferably has a sloped roof 27 to allow rain to come off. Preferably, a metal collar 24 made of an angle iron extends around the upper rim 14. The hinges 22 are preferably secured to the metal collar 24. The metal collar 24 is bolted to the upper rim 14 with the upwardly extending leg 20 of the collar 24 towards the outside. As shown in FIG. 3, the lower rim 17 of upper leak proof compartment 18 has a downwardly extending lip 19 running around the outer periphery of the lower rim 17 of the upper leak proof compartment 18. The lip 19 should extend beyond the collar 24 on all sides of the secondary containment tub 10.

The secondary containment tub 10 is preferably used in combination with a tank 26 disposed within the secondary containment tub 10. The tank 26 is preferably; supported above the base 16 of the lower leak proof compartment 12 on a metal (steel, preferably Galvanized steel) stand 28 at a level such that the tank cannot float in fluid spilled from the tank 26 into the lower leak proof compartment 12. The lower leak proof compartment 12 should have a capacity at least 150% of the carrying capacity of the tank 26, which permits the tank 26 to partly occupy the lower leak proof compartment 12 without floating in a maximum level spill. If the tank 26 is raised such that no part of it is lower than the upper rim 14 of the lower leak proof compartment 12, then the minimum capacity of the lower leak proof compartment 12 is 110% of the capacity of the tank 26 (to comply with Province of Alberta spill containment rules—AEUB G-55 guidelines) or such other capacity that is required by local regulations.

Figure 5:
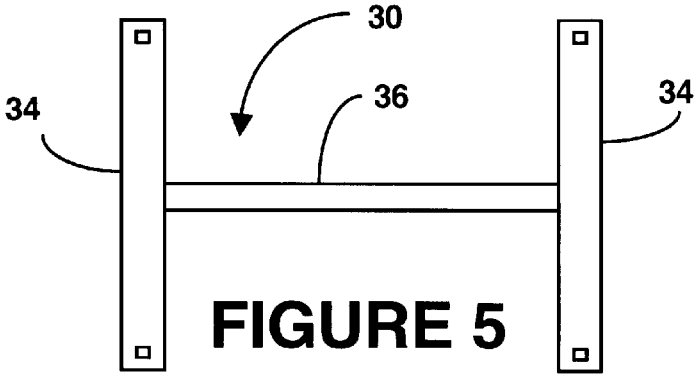
FIG. 5 is a plan view of a frame for supporting the secondary containment tub.

The secondary containment tub 10 is preferably supported by a support base frame 30 formed of two end beams 34 and a central beam 36 (see FIG. 5). Preferably, the lower central section 25 of the lower leak proof compartment 12 sits directly on the end beams 34. The end beams 34 are preferably channel irons. The base frame 30 may be supported by a variety of means, depending on the application. For example, for supporting the secondary containment tub 10 well above the ground, a support frame 31 may be used, formed of a metal frame with four uprights or legs 32 and cross-braces 38 between the uprights 32. The support 31 is preferably made of steel.

Figure 4:
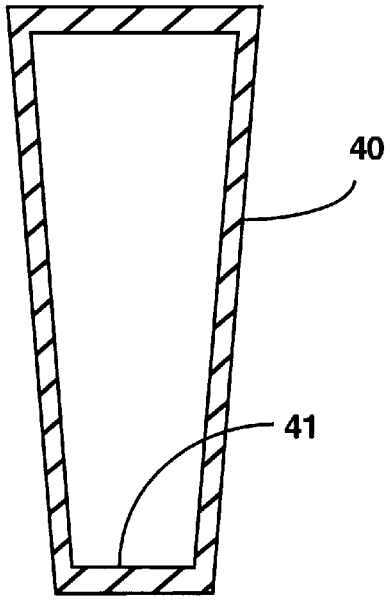
FIG. 4 is a section through a side rib of one of the upper or lower compartments.

To secure the secondary containment tub 10 to the base frame 30, the lower compartment is provided at least with strengthening ribs 40 at each corner of the lower leak proof compartment 12. As shown in FIG. 4, the corner ribs 40 are preferably hollow and have a lower flange 41, which is clamped to the cross-beam 34 by a clamp 42 fastened over the flange 40. Other intermediate ribs may be provided on the lower leak proof compartment 12, but since these do not require a flange for fastening the secondary containment tub 10 to the base frame 30, the intermediate ribs do not need to be hollow and may be solid. To assist in stacking, the ribs 40 should taper inward towards the base of the lower leak proof compartment 12. The upper leak proof compartment 18 is preferably made symmetrically to the lower leak proof compartment 12 so that only one mould is required. To accommodate the lip 19, the mould can be made with the lip and to produce the upper rim 14, the lip on the upper rim of the lower leak proof compartment 12 can be broken off at the equivalent position to the line 21 shown in the upper leak proof compartment 18.

The cover 18 is preferably made of plastic, and serves to protect the tank 26 from the environment, and prevent leaves and other debris collecting around and in the tank. The cover 18 is also preferably provided with a vent 46 to prevent build up of vapours in the secondary containment tub 10, and a sight glass window 48 so that an operator may view a sight glass or other liquid level gauge on the tank 26. The support 30 may maintain the lower leak proof compartment 12 at any desired height, and may include skids (not shown). The secondary containment tub 10 will accommodate a variety of plastic, fiberglass, steel, round, flat or square single wall tanks 26 having a capacity up to 1200 gallons. The cover 18 and lower leak proof compartment 12 are preferably tapered so that they may be nested for storage. The hinges 22 may be on either side, or both sides (in the case of a butterfly cover 18), of the lower leak proof compartment 12.

The secondary containment tub 10 is preferably made from high density polyethylene weather resistant plastic. The lower leak proof compartment 12 may also include a moulded platform in the base 16 for a pump, and a drain in the base 16 for recovery of spilled fluids.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A secondary containment tub and tank in combination, comprising:

a lower leak proof compartment having an upper rim and a base;

a cover hinged to the upper rim by hinges;

a tank disposed within the secondary containment tub, the tank being supported above the base of the lower leak proof compartment at a level such that the tank cannot float in fluid spilled from the tank into the lower leak proof compartment;

a flange on the base for securing the lower leak proof compartment to a support; and the base lying in a generally horizontal plane and the flange extending outward from the lower leak proof compartment in a direction parallel to the horizontal plane of the base.

2. A secondary containment tub, comprising:

a lower leak proof compartment having an upper rim and a base;

a cover hinged to the upper rim by hinges;

a flange on the base for securing the lower leak proof compartment to a support;

and a support for the lower leak proof compartment, the support being clamped to the lower leak proof compartment by a clamp fastened over the flange.

3. The secondary containment tub of claim 2 in which the support comprises a metal frame having four support legs.

4. The secondary containment tub of claim 2 further in combination with a tank disposed within the secondary containment tub, the tank being supported above the base of the lower leak proof compartment at a level such that the tank cannot float in fluid spilled from the tank into the lower leak proof compartment.

5. The secondary containment tub of claim 4 in which the tank is supported on a stand within the lower leak proof compartment.

6. A secondary containment tub and tank in combination, comprising:

a lower leak proof compartment having an upper rim and a base;

a cover hinged to the upper rim by hinges;

a tank disposed within the secondary containment tub, the tank being supported above the base of the lower leak proof compartment at a level such that the tank cannot float in fluid spilled from the tank into the lower leak proof compartment, a support for the lower leak proof compartment; and a flange on the base for securing the lower leak proof compartment to a support, the support being clamped to the lower leak proof compartment by a clamp fastened over the flange.

7. The secondary containment tub and tank of claim 6 in which the tank is supported on a stand within the lower leak proof compartment.

8. The secondary containment tub and tank of claim 7 further comprising a metal collar extending around the upper rim.

9. The secondary containment tub and tank of claim 8 in which the hinges are secured to the metal collar.

10. The secondary containment tub and tank of claim 9 in which the metal collar is formed of an angle iron.

11. The secondary containment tub and tank of claim 6 in which the support comprises a metal frame having four support legs.

12. The secondary containment tub of claim 2 in which the base lies in a generally horizontal plane and the flange extends outward from the lower leak proof compartment in a direction parallel to the horizontal plane of the base.

13. A secondary containment tub, comprising:

a lower leak proof compartment having an upper rim and a base;

a flange on the base for securing the lower leak proof compartment to a support;

the base lying in a generally horizontal plane;

the flange extending outward from the lower leak proof compartment in a direction parallel to the horizontal plane of the base; and a support for the lower leak proof compartment, the support being clamped to the lower leak proof compartment by a clamp fastened over the flange.

14. The secondary containment tub of claim 13 further in combination with a support for the lower leak proof compartment.

15. The secondary containment tub of claim 14 in which the support is clamped to the lower leak proof compartment by a clamp fastened over the flange.

16. The secondary containment tub of claim 13 in which the support comprises a metal frame having four support legs.

17. The secondary containment tub of claim 13 in which the support comprises a metal frame having four support legs.

18. The secondary containment tub of claim 13 further in combination with a tank disposed within the secondary containment tub, the tank being supported above the base of the lower leak proof compartment at a level such that the tank cannot float in fluid spilled from the tank into the lower leak proof-compartment.

19. The secondary containment tub of claim 18 in which the tank is supported on a stand within the lower leak proof compartment.

* * * * *